US006159039A

United States Patent [19]

Wu

[11] Patent Number: 6,159,039

[45] Date of Patent: Dec. 12, 2000

[54] STACKED ELECTRICAL CONNECTOR ASSEMBLY

[75] Inventor: Kun-Tsan Wu, Tu-Chen, Taiwan

[73] Assignee: Hon Hai Precision Ind. Co., Ltd., Taipei Hsien, Taiwan

[21] Appl. No.: 09/295,969

[22] Filed: Apr. 21, 1999

[30] Foreign Application Priority Data

Dec. 18, 1998 [TW] Taiwan ..... 87221139

[51] Int. Cl.[7] ..... H01R 13/60

[52] U.S. Cl. ..... 439/541.5

[58] Field of Search ..... 439/541.5, 676, 439/620, 660, 607, 609, 79, 490, 701

[56] References Cited

U.S. PATENT DOCUMENTS

| | | | |
|---|---|---|---|
| 5,443,403 | 8/1995 | Weidler et al. | 439/701 |
| 5,687,233 | 11/1997 | Loudermilk et al. | 379/442 |
| 5,957,730 | 9/1999 | Wang | 439/676 |
| 5,980,320 | 11/1999 | Slack et al. | 439/607 |
| 6,027,375 | 2/2000 | Wu | 439/607 |

*Primary Examiner*—Paula Bradley
*Assistant Examiner*—Alexander Gilman
*Attorney, Agent, or Firm*—We Te Chung

[57] ABSTRACT

An electrical connector assembly includes a substantially cuboidal main dielectric housing having a first partition dividing an inner space thereof into an upper space and a lower space. An RJ45 modular jack is mounted in the first space which has a top wall abutting against a top wall of the main housing and defining two recesses. Two LEDs for indicating the connecting condition of the RJ45 connector with a mating connector are received in the recesses. A second type connector consisting of two USB connector units is mounted to the second lower space. A second partition continues from the first partition to define a third space between the second space and a rear side of the main housing. A rear part of the second type connector abuts the second partition. A transformer for filtering noise received by the RJ45 modular jack is received in the third space and soldered between contact portions and tail portions of contacts of the RJ45 modular jack. A housing of the second type connector defines a groove in a front face thereof which fittingly receives a beams formed at a lower part of a front side of the main housing.

12 Claims, 8 Drawing Sheets

STACKED ELECTRICAL CONNECTOR ASSEMBLY

BACKGROUND OF THE INVENTION

1. Field of the Invention

The present invention relates to an electrical connector assembly, and particularly to an electrical connector assembly with at least two different type connectcrs stacked together in a compact manner and with a secured structure.

2. The Prior Art

Following the development of network industry, a variety of types of connectors are proposed to meet different requirements. For example, RJ45 module jacks are used for connecting two data processing units together in a local area network (LAN). A universal serial bus (USB) connector is used for connecting a periphery device to a host computer. It is more and more desirable to mount different types of connectors in a printed circuit board (PCB). If these connectors are co-planely mounted to the PCB, a large portion of area of the PCB will be occupied by the connectors. This is very not economical in view of the precious area of the PCB, particularly fcr a nowadays electronic device which requires a high density arrangement of components in a PCB having a limited space. Furthermore, to respectively mount the connectors to the PCB is time consuming, causing a relatively high cost of the device.

Thus, an assembly with stacked different types of connectors is proposed whereby the connectors can be quickly mounted to the PCB and occupy a less area thereof.

However, until now none of the prior art stacked connector assemblies has a structure which can very securely connect two different type connectors together, while has a compact design, particularly when the assembly has indicator (LEDs) for indicating the connecting condition of one type of the connectors.

Hence, an improved connector assembly with stacked two different type connectors and indicators is needed to eliminate the above mentioned defects of current stacked connector assembly.

SUMMARY OF THE INVENTION

Accordingly, an objective of the present invention is to provide an electrical connector assembly with two different type connectors and indicators stacked together wherein these components are securely assembled together in a compact fashion.

To fulfill the above mentioned objective, according to one embodiment of the present invention, an electrical connector assembly includes a substantially cuboidal main dielectric housing having a first partition dividing an inner space thereof into an upper space and a lower space. An RJ45 modular jack is mounted in the first space which has a top wall abutting against a top wall of the main housing and defining two recesses near two lateral sides thereof. Two LEDs for indicating the connecting condition of the RJ45 connector are received in the recesses. A second type connector consisting of two IJSB connectors sharing an integral dielectric housing is mounted to the lower space. A second partition continues from the first partition to define a third space between the second space and a rear side of the main housing. A rear part of the second type connector abuts the second partition. A transformer for filtering noise received by the RJ45 modular jack is received in the third space and soldered between contact portions and tail portions of contacts of the RJ45 modular jack. The housing of the second type connector defines two holes extending therethrough, two lateral passages extending from a rear side of the housing to communicate with the holes, two front shielding members mounted in the two holes, and a rear shielding member fixed to the rear side of the housing and having two lateral walls extending through the passages to fixedly connect with the front shielding members. The housing of the second type connector defines a central groove in a front face thereof. The groove fittingly receives a mounting beam formed by the main housing which is located at a lower portion of a front side of the main housing.

DETAILED DESCRIPTION OF THE PREFERRED EMBODIMENT

Figure 1A:
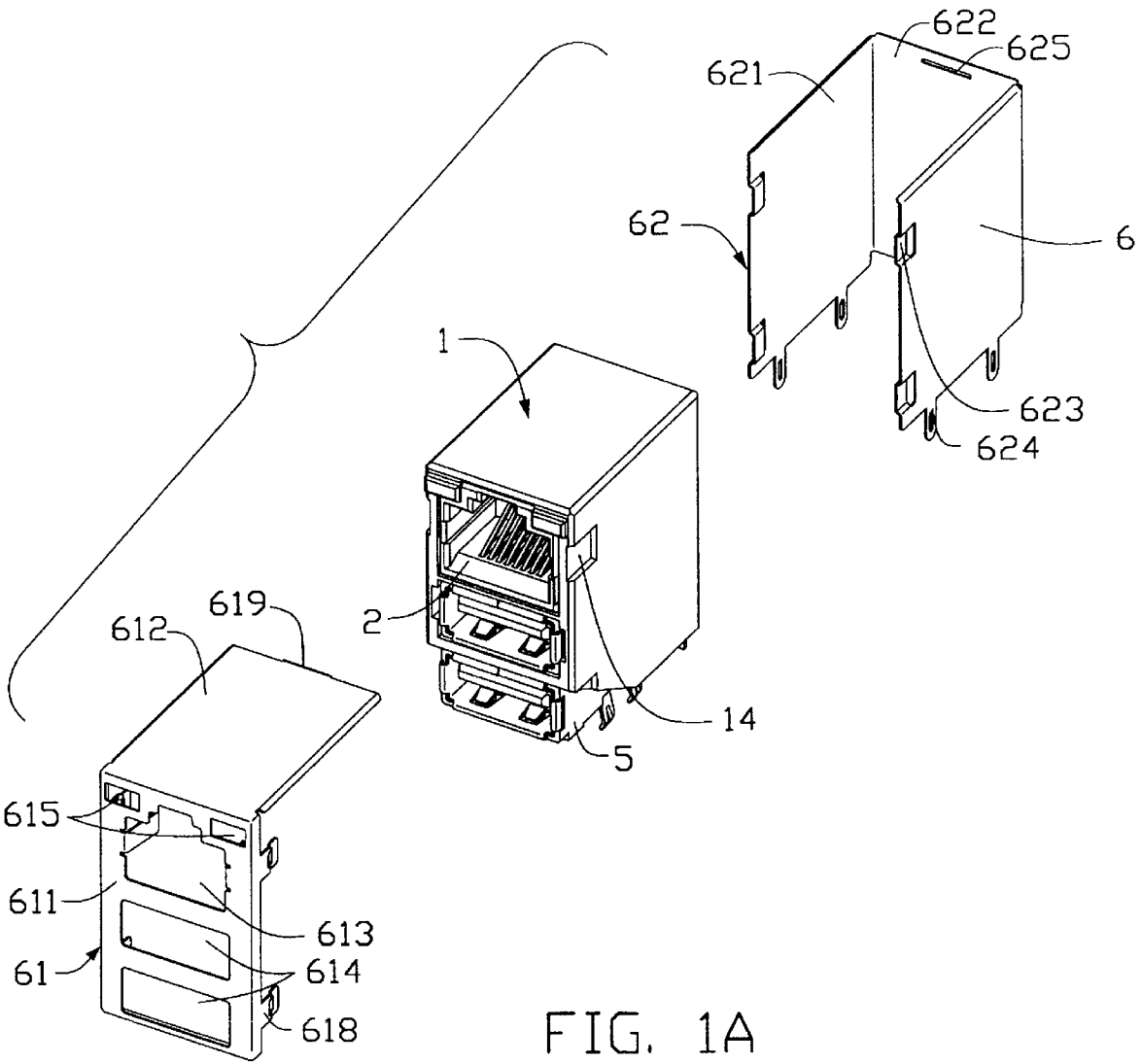
FIG. 1A is an exploded view of an electrical connector assembly in accordance with the present invention with a front and rear shielding member separated from a sub-assembly thereof.
Figure 1B:
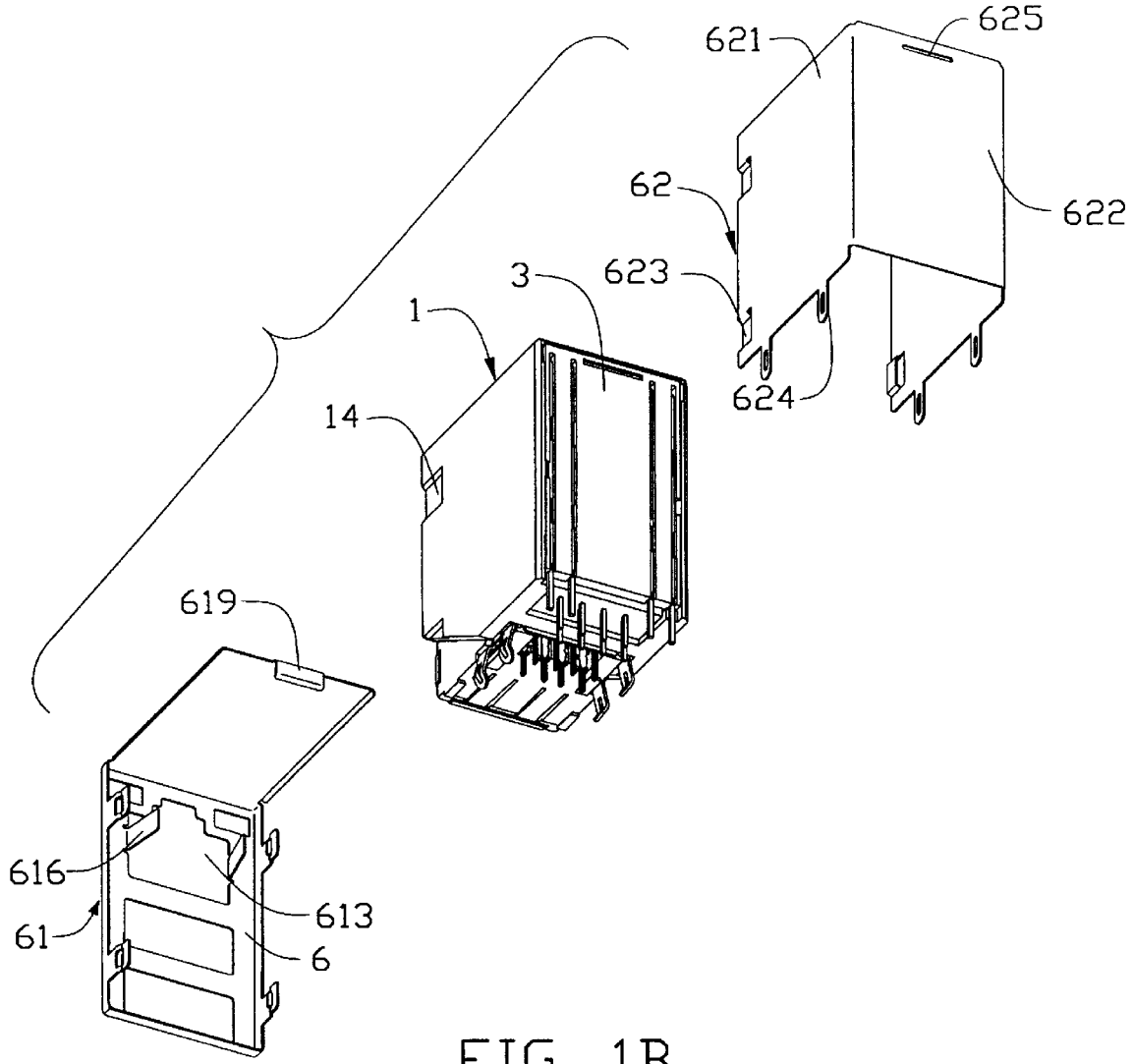
FIG. 1B is a view similar to FIG. 1A as viewed from a different angle.
Figure 2A:
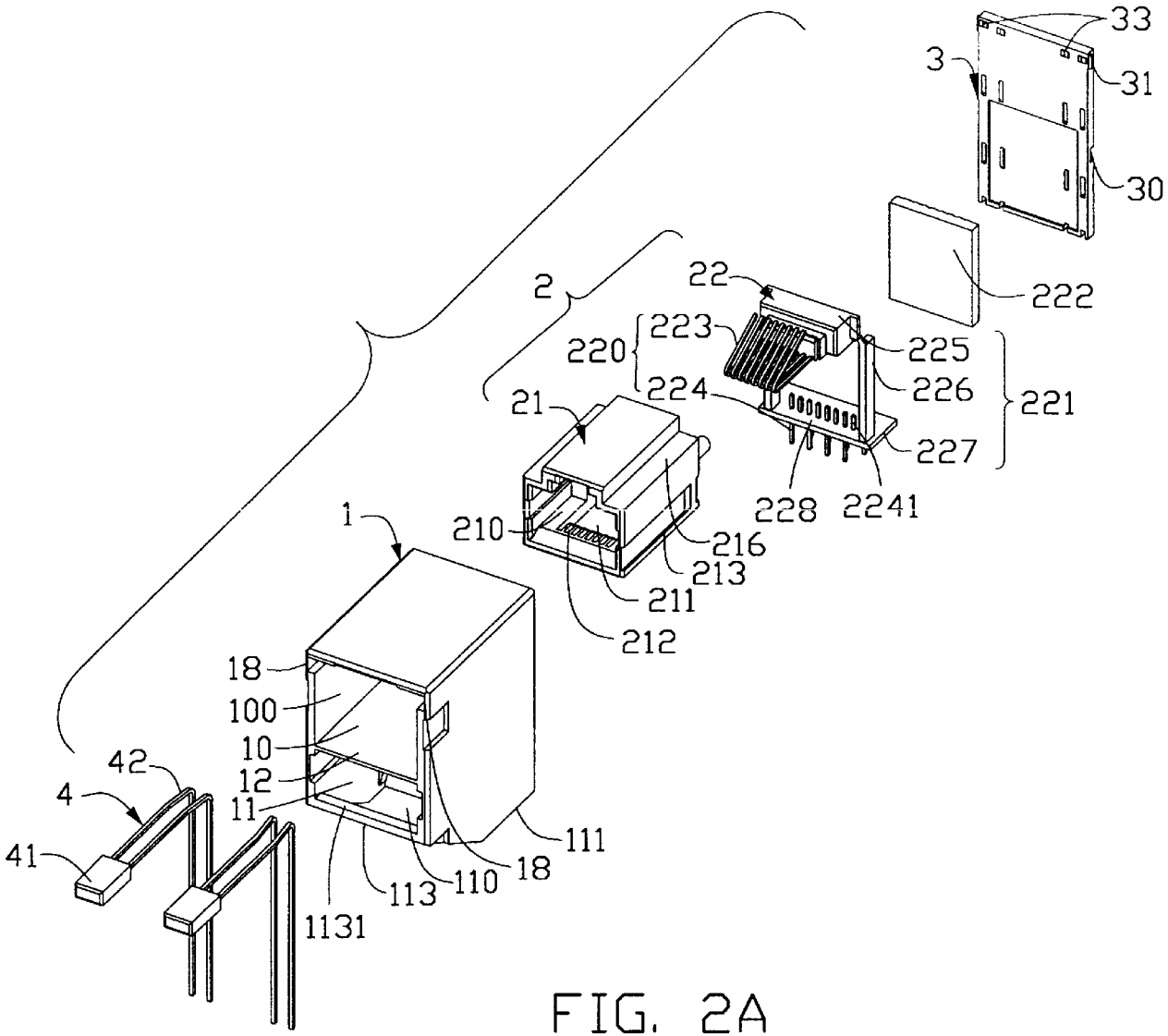
FIG. 2A is an exploded view of first type connector of the electrical connector assembly in accordance with the present invention.
Figure 2B:
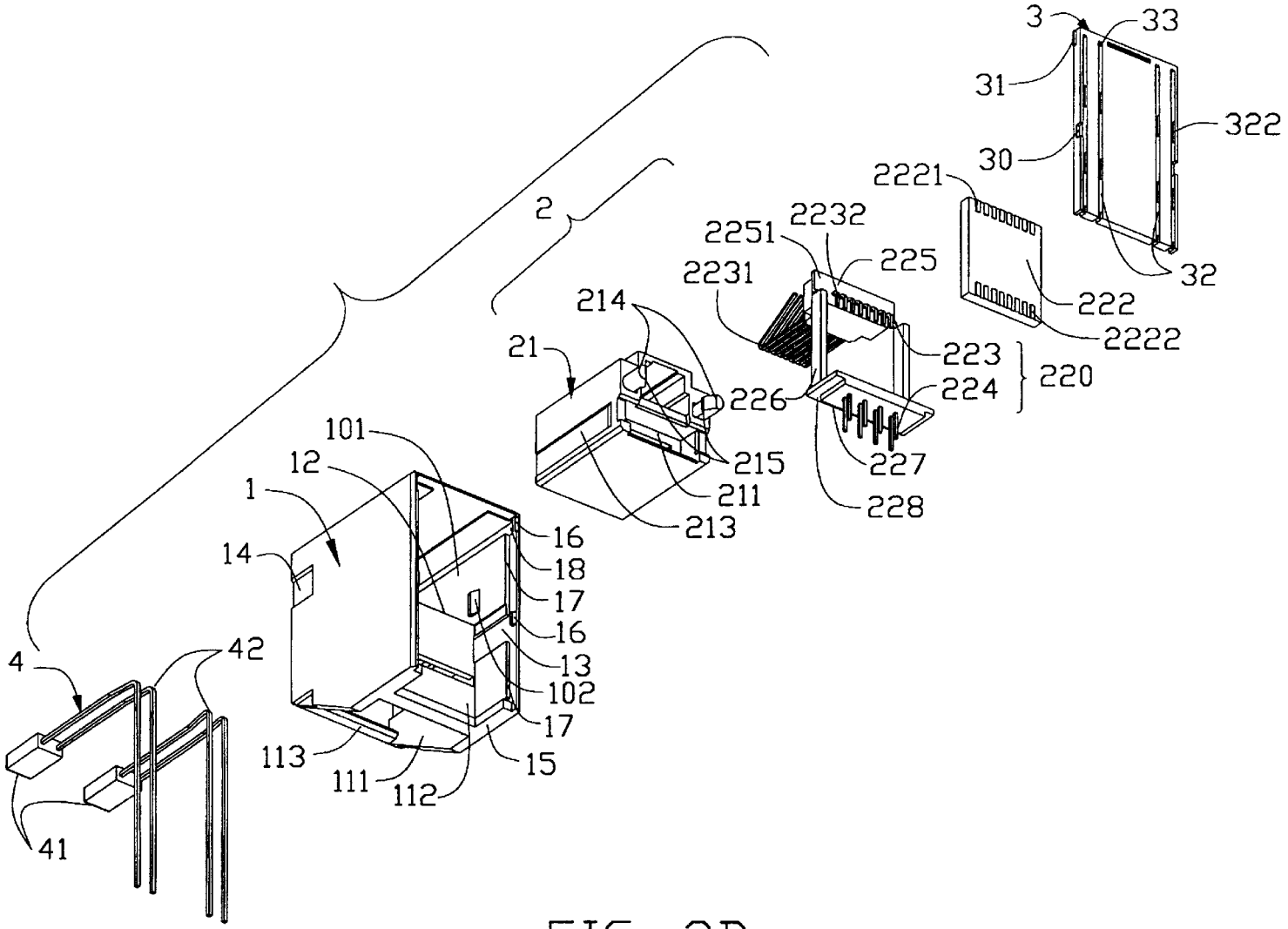
FIG. 2B is a view similar to FIG. 2A as viewed from different angle.

Reference will now be made in detail to the preferred embodiment of the present invention.

Referring to FIGS. 1A–2B, a stacked electrical connector assembly in accordance with the present: invention consists of a main dielectric housing/bracket 1, a first type connector 2, a second type connector 5, two light emitting diodes (LEDs) 4, an a metal 6, wherein the main housing 1 has a substantially cuboidal configuration with a horizontal partition 12 separating an inner space of the main housing 1 into an upper space 10 and a lower space 11. The upper space 10 defines a front side 100 for insertion of a mated connector therethrough to electrically connect with the first type connector 2, and a rear side 101. Two ramped protrusions 102 (only one shown) are formed on two opposite side walls (not labeled) of the main housing 1 defining the upper space 10 near the horizontal partition 12. The lower space 11 defines a front side 110 for insertion of a mated connector therethrough to connect with an upper unit of the second type connector 5 and a bottom side 111 from which the upper unit of the second type connector 5 can be mounted into the main housing 1. A vertical partition 112 continues downwards from the horizontal partition 12 to form a rear wall of the lower space 11. A mounting beam 113 is integrally formed with the main housing 1 between the front side 110 and bottom side 111 of the second space 11. The mounting beam 113 forms a guiding surface 1131 declining downwardly and rearwardly. The main housing 1 further defines a rear space 13 in rear of the vertical partition 112. The rear space 13 communicates with the upper space 10 via the rear side 101 of the upper space 10, and separates from the lower space 11 by the vertical partition 112. The main housing 1 defines two depressions 14 on an outside of the two side walls thereof, which are located corresponding to the upper space 10 and extend rearwardly from the front side of the housing 1. The main housing 1 further forms a bottom face 15, two engaging teeth 16 arranged on an inner face of each side wall of the housing 1 proximate the rear side thereof and two stops 17 also on the inner face of each side wall of the housing 1 and in front of the engaging teeth 16 and spaced therefrom a distance (best seen in FIG. 2B). A groove 18 is defined in a top of the inner face of each side wall of the housing 1 and exterds from the front side to the rear side thereof.

The first type connector 2, which is a receptacle RJ45 modular jack in this preferred embodiment, is received in the upper space 10 of the main housing 1. The first type connector 2 consists of a first subsidiary dielectric housing 21 defining a through hole 210 extending from a front side to a rear side thereof for receiving a plug RJ45 modular jack (not shown) therein. Eight cuts 212 are defined in a front portion of the first subsidiary housing 21 facing the rear side thereof. A recess 213 is defined in a lower portion of an outer face of each side wall of the first subsidiary housing 21, and a depression 216 is defined in each of lateral sides of a top wall of the housing 21. Two posts 21 are integrally formed with the first subsidiary housing 21, extending rearwardly from the rear side thereof and beside the through hole 210. Each post 21 forms a hook 215 at a free end thereof projecting toward the through hole 210.

A second subsidiary dielectric housing 221 is insert molded with eight contacts 220 each having an upper contact portion 223 for electrically connecting with the mated plug connector and a lower tail portion 224 for being soldered to a PCB. The second subsidiary housing 221 has a block 225 interferentially engaging with the contact portions 223, a lower plate 227 interferentially engaging with the tail portions 224 and two lateral rods 226 located therebetween concerning the vertical direction. The two rods 226 define a receiving space 228 therebetween concerning the horizontal direction. Each contact portion 223 further defines an arcuated bend 2231 in front of the block 225 and a solder foot 2232 in rear of the block 225. Each tail portion 224 further defines a solder head 2241 above the plate 227.

A transformer 222 includes a daughter board having eight upper golden fingers 2221 and corresponding eight lower golden fingers 2222, and a number of noise filtering electronic components (for example, capacitors, not. shown) thereon, wherein the noise filtering electronic components are electrically connected with the golden fingers 2221, 2222. The transformer 222 is used for filtering noise received by the first type connector 2 thereby preventing the noise from being transmitted into the electronic device in which the connector assembly in accordance with the present invention is mounted.

To assemble the first type connector 2, the transformer 222 is connected to the second subsidiary housing 221 by putting the transformer 222 into the receiving space 228 and soldering the upper golden fingers 2221 to the solder feet 2232 and the lower golden fingers 2222 to the solder heads 2241. Then, the contact portions 223 are brought to extend into the thorough hole 210 from a rear side thereof to reach a position wherein the arcuated bends 2231 of the contact portions 223 are respectively fixedly received in the cuts 212, and the hooks 215 of the posts 214 fixedly engage with a rear face 2251 of the block 225 of the second subsidiary housing 221.

Figure 3A:
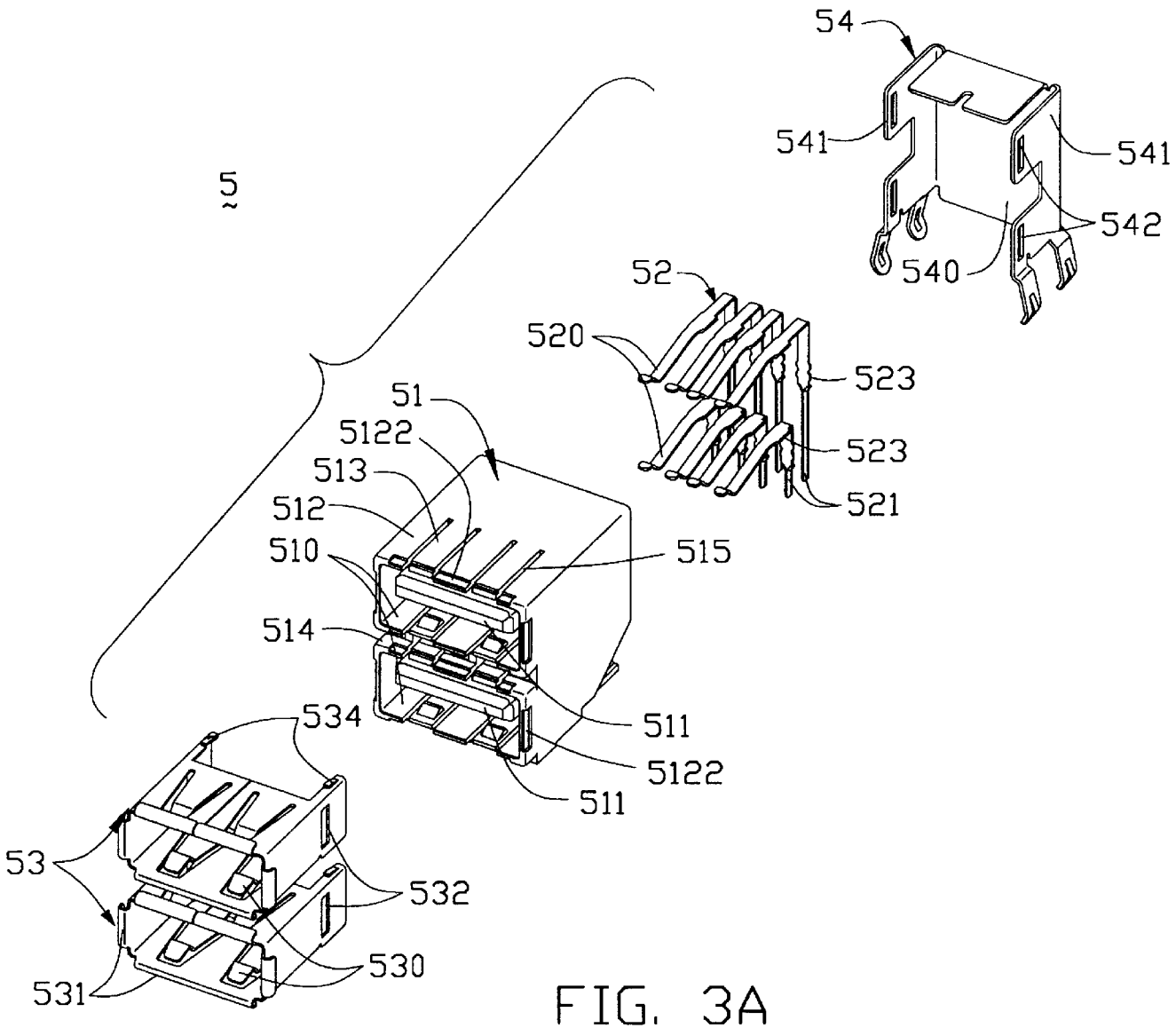
FIG. 3A is an exploded view showing the main components constituting second type connector of the connector assembly in accordance with the present invention.
Figure 3B:
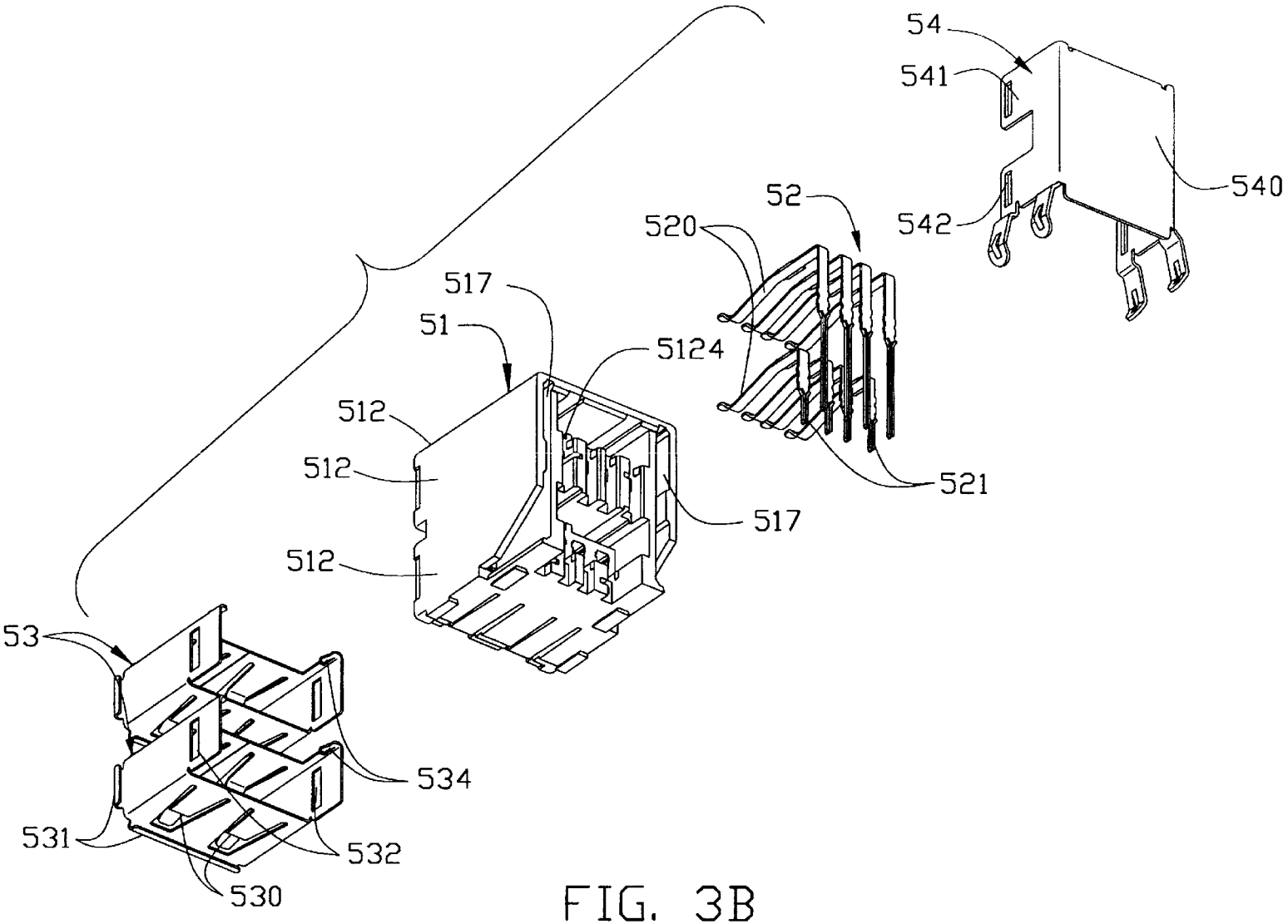
FIG. 3B is a view similar to FIG. 3A as viewed from a different angle.

Referring to FIGS. 3A and 3B, the second type connector 5 consists of two units each being a Universal Serial Bus (USB) plug connector. The second type connector 5 is constructed by the following manner. A third subsidiary dielectric housing 51 is formed by plastic injection molding to have an upper unit and a lower unit generally separated from each other by a groove 514. Each unit has an rectangular outer wall 512 defining a mated connector receiving space 510. A platform 511 is integrally formed with the outer wall 512 and defines four contact passageways 5124 for fitting with four contacts 52 each having an arcuated contact portion 520 for electrically engaging with a mated USB receptacle connector (not shown) and a tail portion 521 for being soldered to the PCB. Each outer wall 512 has upper, lower, left and right portions each defining a front recess 5122. Furthermore, the upper and lower portions of each outer wall 512 define four slits 515 therein thereby forming two resilient cantilevers 513 beside the two outer-most ones of the slits 515, respectively. The housing 51 further defines two passages 517 extending forwardly from a rear side of the housing 51 near the left and right portions of the outer walls 512 to communicate with the mated connector receiving spaces 510. Two front shielding members 53 each are formed by stamping a metal sheet to have a generally hollow cuboidal configuration having an outer wall with upper, lower, left and right portions each having a rearward projection 531 at a front end thereof. Each of the upper and lower portions is formed with two tabs 530 therein for electrically engaging with a metal of the mated connector. Furthermore, the upper portion is formed with two pegs 534 near a rear end thereof. Each of the right and left portions is formed with a rectangular holes 532. A rear metal 54 is formed by stamping a metal sheet to have a main body 540, two side walls 541 extending forwardly from two lateral sides of the main body 540 and two feet extending downwardly from each of the side walls 541 for being soldered to a grounding circuit of the PCB. Each side wall 541 forms two vertically-aligned bulges 542 near a front edge of an outer surface thereof.

To assemble the second type connector 5, the contacts 52 are firstly mounted to the third subsidiary housing 51 to reach a position where barbs 523 on each of the contacts 52 interferentially engage with the housing 51 and the contact portions 520 are received in a front part of the contact passageways 5124. The rear 54 is mounted to the housing 51 by extending its two side walls 541 into the passages 517 to reach a position wherein the main body 540 thereof abuts against the rear side of the housing 51. Finally, the front shielding members 53 are successively mounted into the receiving spaces 510 to reach a position in which the projections 531 are fittingly received in corresponding front recesses 5122 of the outer walls 512 of the housing 51, the pegs 534 interferentially engage with the housing 51 and the bulges 542 fittingly extend into the holes 532 to fixedly engage with the right and left walls of the front shielding members 53.

Figure 4:
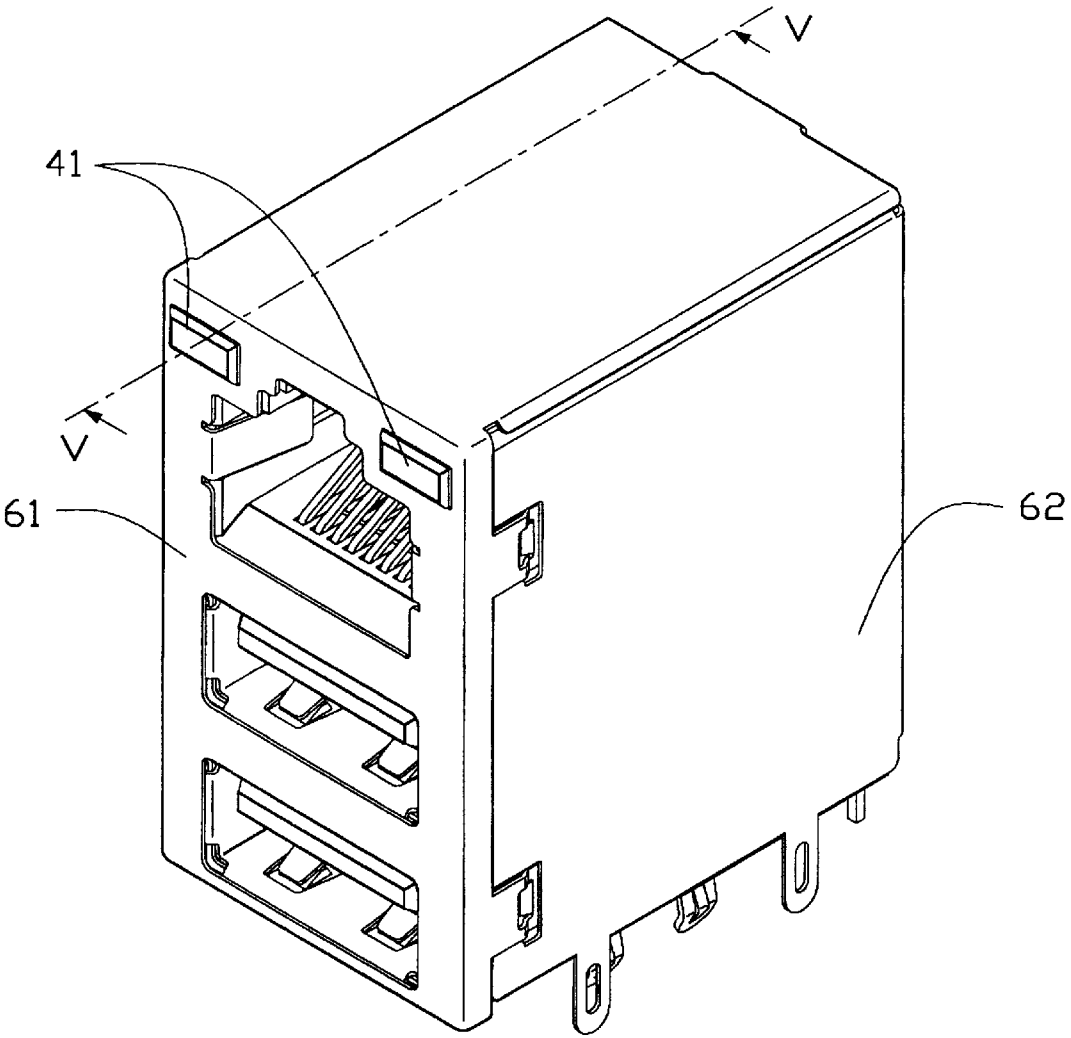
FIG. 4 is a perspective view of the connector assembly of the present invention.
Figure 5:
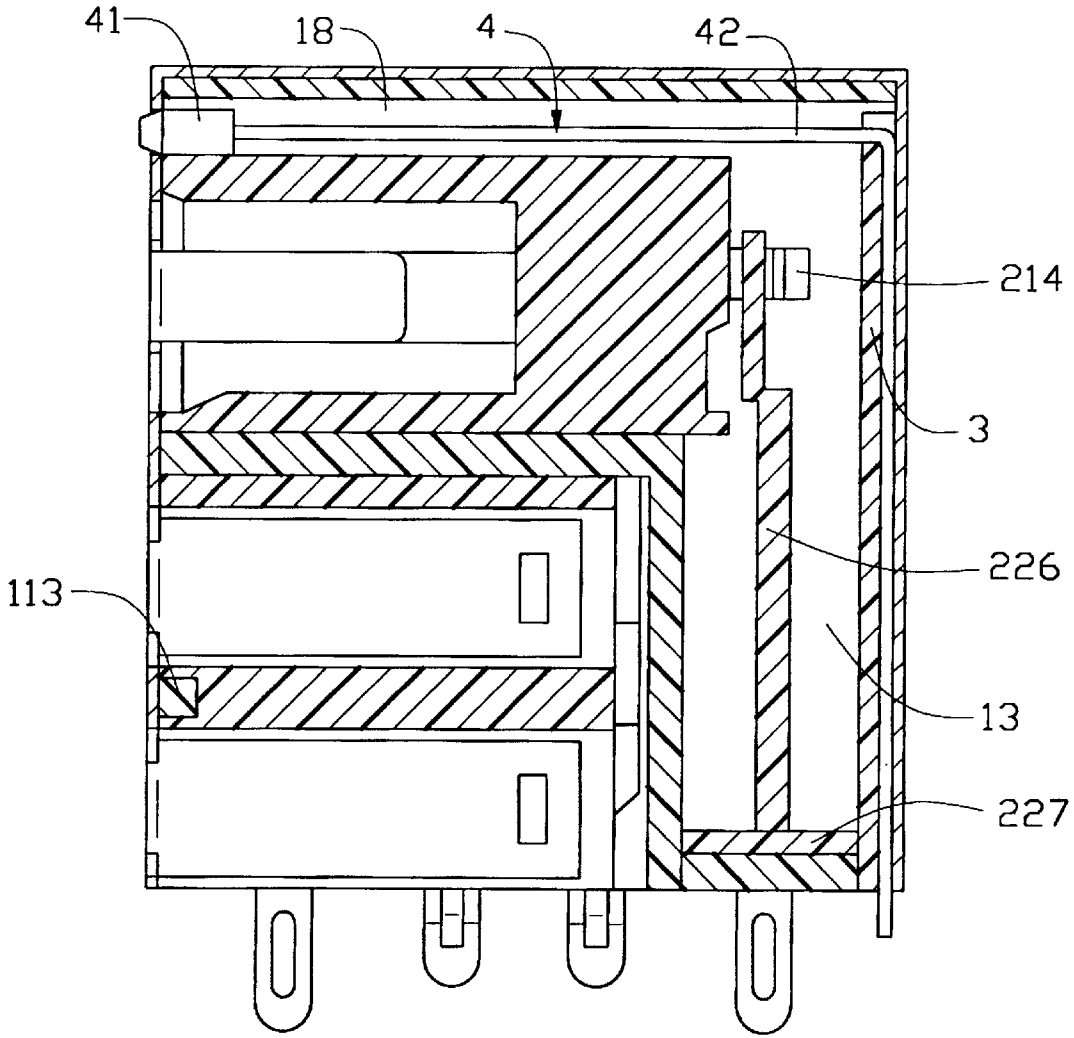
FIG. 5 is a cross-sectional view taken alone line 5—5 of FIG. 4.

Also referring to FIGS. 4 and 5, to assemble the connector assembly in accordance with the present invention, the first type connector 2 is mounted to the main housing 1 by extending the first subsidiary housing 21 into the upper space 10 of the main housing 1 via the rear side 101 thereof to reach a position wherein the ramped protrusions 102 engage with a rear end of the recesses 213, a front side of the first subsidiary housing 21 is flush with a front side of the main housing 1, and the lateral rods 226 and lower plate 227 of the second subsidiary housing 221 and the transformer 222 are received in the rear space 13. The second type connector 5 is then assembled to the main housing 1 by firstly fitting the mounting beam 113 into the groove 514 to reach a position wherein a front part of the upper unit of the second type connector 5 extends into the lower space 11 via the bottom side 111 thereof. The second type connector 5 is then turned counterclockwise to reach a position as shown in FIG. 1A, wherein a front side of the upper unit of the second type connector 5 is flush with the front side of the main housing 1. By the design of the guiding surface 1131, the second type connector 5 can easily reach the finally assembled position. Afterwards, the LEDs 4 are assembled with a rear cap 3 which is formed by plastic injection molding to have a substantially plate-like configuration defining four vertically extending furrows 32 in a rear surface thereof. Two retaining keys 322 are formed in each furrow 32. A through hole 33 is defined in a top of each furrow 32. The rear cap 3 further forms an upper tooth 31 and a lower indent 30 on each of lateral. sides thereof. The leads 42 of the LEDs 4 which originally have a straight form are extended through the holes 33 from a front face of the cap 3 a determined length. The portions of the leads 42 which are extended beyond the rear face of the cap 3 are then bent vertically to light bulbs 41 of the LEDs 4 and embedded into the furrows 32 to be retained therein by the keys 322. The LEDs 4 and the rear cap 3 are then together assembled to the main housing 1 by running forwardly the bulbs 41 through the grooves 18 and the depressions 216 to reach a position wherein a front portion of each bulb 41 projects out the front side of the main housing 1 a distance, and the rear cap 3 is fixed to the rear side of the main housing 1 to a position wherein a front face of the rear cap 3 abuts against the stop 17, the engaging teeth 16 respectively engage with the upper teeth 31 and fit into the lower indents 30.

The metal shielding 6 includes a main front shielding member 61 with a generally L-shaped configuration, and a main rear shielding member 62 with a generally U-shaped configuration. The front shielding member 61 is formed by stamping a metal sheet to include an upper horizontally extending cover 612 forming a locking hook 619 at a rear end thereof, and a vertically extending panel 611 defining two LED holes 615, a RJ45 modular jack hole 613 and two USB connector holes 614, in a substantially vertical sequence. A pair of two stepped mounting tabs 618 extend rearwardly from two lateral edges of the front panel 611. The rear shielding member 62 includes a main body 622 defining a slit 625 in a top portion thereof. Two wings 621 extend forwardly from two lateral edges of the main body 622. Each wing 621 defines two concaved portions 623 at a front side thereof, and two soldering legs 624 at a bottom edge thereof. The soldering legs 624 are used for being soldered to a PCB to electrically connect with a grounding circuit thereof.

The assembling of the connector assembly in accordance with the present invention is completed bad mounting the front and rear shielding members 61, 62 to the main housing 1. The rear shielding member 62 is firstly mounted to the housing 1 to reach a position in which the main body 622 abuts the rear face of the rear cap 3, the wings 62 cover the left and right side walls of the housing 1, and the concaved portions 623 fixedly rest against the depressions 14. Thereafter, the front shielding member 61 is mounted to the main housing 1 to engage with the rear shielding member 62 by fitting the hook 619 into the slit 625 and having the mounting tabs 618 clamping the concaved portions 623 of the wings 621 of the rear shielding member 62. When the front shielding member 61 is mounted to the main housing 1, the LED receiving holes 625 fittingly receive the front portion of the LEDs 4, and the modular jack hole 613 and the USE connector holes 614 respectively align with the RJ45 modular jack 2 and the two USB connector units of the second type connector 5. The front shielding member 61 further forms two grounding tabs 616 extending into the inner space of the RJ45 modular jack 2 for engaging with a shielding member of a connector (not shown) mating therewith. The LEDs 4 are used for indicating the connecting situation of the RJ45 modular jack 2 with the mating connector.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

I claim:

1. An electrical connector assembly, comprising:

a substantially hollow cuboidal dielectric main housing having a first partition dividing an inner space of the main housing into a first space and a second space, and a second partition perpendicular to the first partition, said second partition defining a third space of the main housing between the second space and a rear side of the main housing;

a first type connector mounted in the first space, said first type connector comprising a first subsidiary housing and a second subsidiary housing, said first subsidiary housing having a top wall abutting against a top wall of the main housing, a recess being defined in the top wall of the first subsidiary housing, the first subsidiary housing defining a hole extending therethrough and a number of cuts in the hole, and the second subsidiary housing fixed to the first subsidiary housing and having an upper block and a lower plate, a number of upper contacts fixed to the block, a corresponding number of lower contacts fixed to the plate, a transformer for filtering noise received by the first type connector being soldered to the upper and lower contacts, each upper contact being formed with a bent portion extending into the hole and fittingly received in a corresponding cut;

a second type connector mounted in the second space of the main housing; and an indicator for indicating the connecting condition of the first type connector with a mated connector, said indicator being mounted in the recess of the top wall of the first subsidiary housing;

wherein said transformer and said plate of the second subsidiary housing are received in the third space of the main housing.

2. The connector assembly in acccrdance with claim 1, wherein the second type connector includes two substantially similar connector units mounted in a third subsidiary housing which has a groove between the two connector units, the groove fittingly receiving a mounting beam formed by the main housing.

3. The connector assembly in accordance with claim 1, wherein the second subsidiary housing is fixed to the first subsidiary housing by engaging two hooks of the first subsidiary housing with the upper block of the second subsidiary housing.

4. The connector assembly in accordance with claim 1, wherein the main housing has ramped protrusions formed on an inner side of each of lateral walls thereof, the protrusions engaging two lateral side walls of the first subsidiary housing.

5. The connector assembly in accordance with claim 1, wherein the indicator is a light emitting diode including a bulb and two terminals, the assembly further comprising a rear cap fixed to a rear side of the main housing, the rear cap comprising two furrows located in an outer face thereof and extending from a top of the rear cap to a bottom thereof, the two terminals having a portion being bent to be perpendicular to the bulb and fixedly received in the furrows.

6. The connector assembly in accordance with claim 2, wherein the third subsidiary housing has two holes extending therethrough, a plate integrally formed in each of the holes, the plate defining a number of contact passageways for fixedly receiving a number of contacts therein, two lateral passages extending from a rear side of the third subsidiary housing to communicate with the two holes, and wherein the second type connector further comprises two front shielding members mounted into the two holes, respectively, and a rear shielding member fixed to the rear side of the third subsidiary housing, the rear shielding member having two lateral side walls each extending into a corresponding passage and formed with two bulges interferentially engaging the front shielding members.

7. The connector assembly in accordance with claim 6, wherein each front shielding member forms a number of tabs for connecting with a shielding of a mated connector, the third subsidiary housing forming a number of resilient cantilevers located corresponding to the tabs.

8. The connector assembly in accordance with claim 1 further comprising a front shielding member having a substantially L-shaped configuration with a horizontally extending top cover and a vertically extending front panel, and a rear shielding member having a substantially U-shaped configuration connected with the front shielding member to substantially enclose the main housing, the rear shielding member having a main body and two side walls extending toward the front panel of the front shielding member.

9. The connector assembly in accordance with claim 8, wherein the top cover has a hook at a rear edge thereof, the hook extending to fixedly engage with the main body of the rear shielding member, the front panel defining, in a substantially top-to-bottom sequence, an indicator hole, a first type connector hole and a second type connector hole.

10. The connector assembly in accordance with claim 8, wherein the main housing defines a recess in an outer face of each side wall thereof, each of the side walls of the rear shielding member forming a concaved portion, the front panel of the front shielding member forming a stepped mounting tab extending rearwardly from each lateral side thereof, the mounting tabs clamping the concaved portions into the recesses to fixedly connect the front shielding member, rear shielding member and main housing together.

11. The connector assembly in accordance with claim 2, wherein the mounting beam is located at a lower portion of front side of the main housing from which mating connectors enter the connector assembly to connect therewith.

12. The connector assembly in accordance with claim 11, wherein the mounting beam has a top face inclining rearwardly and downwardly.

* * * * *